US006608613B2

(12) United States Patent
Koyama et al.

(10) Patent No.: US 6,608,613 B2
(45) Date of Patent: Aug. 19, 2003

(54) MATRIX TYPE LIQUID-CRYSTAL DISPLAY UNIT

(75) Inventors: Jun Koyama, Kanagawa (JP); Shunpei Yamazaki, Tokyo (JP)

(73) Assignee: Semiconductor Energy Laboratory Co., Ltd., Atsugi (JP)

( * ) Notice: Subject to any disclaimer, the term of this patent is extended or adjusted under 35 U.S.C. 154(b) by 0 days.

(21) Appl. No.: 10/003,631

(22) Filed: Oct. 29, 2001

(65) Prior Publication Data

US 2002/0036294 A1 Mar. 28, 2002

Related U.S. Application Data

(63) Continuation of application No. 09/474,939, filed on Dec. 30, 1999, now Pat. No. 6,310,598, which is a continuation of application No. 09/300,716, filed on Apr. 27, 1999, now Pat. No. 6,037,924, which is a continuation of application No. 08/730,409, filed on Oct. 15, 1996, now Pat. No. 5,956,011.

(30) Foreign Application Priority Data

Oct. 14, 1995 (JP) ..... 7-291765

(51) Int. Cl.[7] ..... G09G 3/36

(52) U.S. Cl. ..... 345/98; 345/90; 345/92; 345/96; 345/100; 345/204; 345/211; 345/212; 323/313; 348/164; 349/41; 349/42; 349/43; 349/152

(58) Field of Search ..... 345/90, 92, 96, 345/98, 100, 204, 211, 212; 323/313; 349/41–43, 152

(56) References Cited

U.S. PATENT DOCUMENTS 4,571,584 A * 2/1986 Suzuki ..... 340/784
4,769,639 A * 9/1988 Kawamura et al. ..... 340/784
4,922,240 A * 5/1990 Duwaer ..... 340/784
5,159,260 A * 10/1992 Yoh et al. ..... 323/313
5,250,931 A * 10/1993 Misawa et al. ..... 345/206
5,365,250 A * 11/1994 Hirashima ..... 345/94
5,559,526 A * 3/1996 Izawa ..... 345/96
5,570,105 A * 10/1996 Koyama ..... 345/98
5,574,474 A * 11/1996 Tamanoi ..... 345/95
5,574,475 A * 11/1996 Callahan, Jr. et al. ..... 345/100
5,646,643 A * 7/1997 Hirai et al. ..... 345/100
5,663,918 A * 9/1997 Javanifard et al. ..... 365/226
5,666,133 A * 9/1997 Matsuo et al. ..... 345/100
5,680,149 A * 10/1997 Koyama et al. ..... 345/98
5,689,280 A * 11/1997 Asari et al. ..... 345/89
5,712,652 A * 1/1998 Sato et al. ..... 345/90
5,808,595 A * 9/1998 Kubota et al. ..... 345/98
5,899,547 A * 5/1999 Yamazaki et al. ..... 349/43
5,956,011 A * 9/1999 Koyama et al. ..... 345/98
6,037,924 A * 3/2000 Koyama et al. ..... 345/92

* cited by examiner

*Primary Examiner*—Bipin Shalwala
*Assistant Examiner*—Vincent E. Kovalick
(74) *Attorney, Agent, or Firm*—Fish & Richardson P.C.

(57) ABSTRACT

A matrix type liquid-crystal display unit includes: a plurality of pixel portions which are arranged in the form of a matrix; a plurality of signal lines through which a display signal is supplied to the pixel portions; a plurality of scanning lines through which a scanning signal is supplied to the pixel portions; a signal-line drive circuit for driving the signal lines; a scanning-line drive circuit for driving the scanning-lines; a plurality of first thin-film transistors that form the signal-line drive circuit; a plurality of second thin-film transistors that form the scanning-line drive circuit; and a threshold value control circuit being connected to the signal-line drive circuit and the scanning-line drive circuit, for commonly controlling threshold values of the first and second thin-film transistors.

16 Claims, 10 Drawing Sheets

MATRIX TYPE LIQUID-CRYSTAL DISPLAY UNIT

CROSS-REFERENCE TO RELATED APPLICATIONS

This application is a continuation (and claims the benefit of priority under 35 USC 120) of U.S. application Ser. No. 09/474,939, filed Dec. 30, 1999, now U.S. Pat. No. 6,310,598, which is a continuation of U.S. application Ser. No. 09/300,716, filed Apr. 27, 1999, now U.S. Pat. No. 6,037,924, which is a continuation of U.S. application Ser. No. 08/730,409, filed Oct. 15, 1996, now U.S. Pat. No. 5,956,011.

BACKGROUND OF THE INVENTION

1. Field of the Invention

The present invention relates to a matrix type display unit, and more particularly to a matrix type display unit containing a drive circuit therein.

2. Description of the Related Art

The active matrix type display unit is a display unit in which a pixel is arranged at each intersection of a matrix which is made up of signal lines 1 and scanning lines 2, and a switching element is provided for each pixel in such a manner that pixel information is controlled by turning on/off the respective switching elements, as shown in FIG. 2. Liquid crystal 3 is used as a display medium of the display unit of this type. The switching element may be formed of, in particular, a three-terminal element, that is, a thin-film transistor 4 having a gate, a source and a drain.

Also, in the present specification, a "row" in the matrix is defined by the scanning line 2 (gate line), which is arranged in parallel to a subject row, being connected to a gate electrode of the thin-film transistor 4 of the subject row, and a "column" in the matrix is defined by the signal line 1 (source line), which is arranged in parallel to a subject row, being connected to a source (or drain) electrode of the thin-film transistor 4 of the subject column. Furthermore, a circuit that drives the scanning line 2 is called a "scanning line drive circuit", and a circuit that drives the signal line 1 is called a "signal line drive circuit". Also, the thin-film transistor is called a "TFT".

What is shown in FIG. 3 is a first conventional example of the active matrix type liquid-crystal display unit. The active matrix type liquid-crystal display unit of this example has the TFT using amorphous silicon, and the scanning line drive circuits and the signal line drive circuits which are made up of monocrystal integrated circuits (301, 303), and they are fitted onto the periphery of a glass substrate using tabs as shown in FIG. 3A, or the former are fitted onto the latter through the COG (chip on glass) technique as shown in FIG. 3B.

The liquid-crystal display unit of this type suffers from problems stated below. One problem may arise from the viewpoint of the reliability because the signal lines and the scanning lines of the active matrix are connected to each other through the tabs or bonding wire. For example, in the case where the display unit is of VGA (video graphic array), the number of signal lines is 1920, and the number of scanning lines is 480. The number of those lines shows a tendency to increase year by year as the resolution is improved.

In the case of producing a video camera view finder or a projector using liquid crystal, there is required that the display unit is compacted in a lump. The liquid-crystal display unit using the tabs as shown in FIG. 3A is disadvantageous from the viewpoint of a space.

There has been developed the active matrix type liquid-crystal display unit that solves those problems in which TFT is made of polysilicon. One example of this display unit is shown in FIGS. 4A and 4B. As shown in FIG. 4A, a signal line drive circuit 401 and a scanning line drive circuit 402 are formed on a glass substrate 400 together with pixel TFTs of an active matrix 403, using polysilicon TFTs. The formation of the polysilicon TFT is conducted by a high-temperature polysilicon process in which an element is formed on a quartz substrate through a process at 1000° C. or higher, or a low-temperature polysilicon process in which an element is formed on a glass substrate through a process at 600° C. or lower.

The polysilicon TFT can increase its mobility to 30 $cm^2$/Vsec or more whereas the amorphous TFT is about 0.5 $cm^2$/Vsec in mobility. Thus, polysilicon TFT can be operated by a signal of about severals MHz.

The drive circuit that drives the active matrix type liquid-crystal display unit is of the digital type and the analog type. The drive circuit using polysilicon is generally of the analog type. It should be noted that because the number of elements in the circuit of the digital type is remarkably more than that of the analog type, the drive circuit using polysilicon is generally of the analog type. Also, the circuit structure of the scanning line drive circuit and the signal line drive circuit generally uses a shift register 405 in which N-delay type flip flop circuits 404 are connected in series (refer to FIG. 4B).

The above-described conventional liquid-crystal display unit suffers from problems stated below. In the TFT using polysilicon, the control of a threshold value is generally difficult in comparison with a monocrystal transistor, and what is naturally to be of the enhancement type becomes of the depletion type so that a current may flow into a drain even though a voltage between a gate and a source is 0. This is because polysilicon is nonuniform in crystallinity more than monocrystal, a thermal oxide film cannot be used for a gate oxide film in the case of the low-temperature polysilicon, impurity contamination is caused, and so on.

For example, assuming that the TFT characteristic which is to be naturally exhibited by FIG. 5A becomes the characteristic shown in FIG. 5B with a shift of the threshold value, in an initial stage of an invertor circuit 600 shown in FIG. 6, no current flows when an input signal is in a high-state, but a current is caused to flow from a power supply to GND when the input signal is in a low-state. Further, current flows in the next stage in a high condition. Also, in the case where the drive circuit for the liquid-crystal display unit is installed in a substrate of a TFT, its stage number becomes 1120 in total at both of a signal side and a scanning side when the display unit is of the VGA type. As a result, even though a small current flows into each of the TFTs; the total value of the current becomes large. This causes a serious problem from the viewpoint of reducing a power consumption of the display unit.

On the other hand, if the threshold value becomes too large, an on-state current of the TFT is decreased, resulting in such a problem that the operating frequency of the drive circuit is lowered. The operating frequency of the drive circuit is determined by the magnitude of the on-state current when a load capacity and a supply voltage are kept constant because the load capacity is driven by the on-state current of the TFT. Hence, the too large threshold value leads to a lowered operating frequency.

SUMMARY OF THE INVENTION

The present invention has been made in view of the above problems with the conventional display unit, and therefore an object of the present invention is to provide a matrix type display unit that controls the threshold value of TFTs by the application of a voltage, thereby reducing a power consumption of a drive circuit or improving the operating frequency of the drive circuit.

In order to achieve the above object, according to a first aspect of the present invention, there is provided a matrix type liquid-crystal display unit, which comprises: a plurality of pixel portions which are arranged in the form of a matrix; a plurality of signal lines through which a display signal is supplied to said pixel portions; a plurality of scanning lines through which a scanning signal is supplied to said pixel portions; a drive circuit for driving at least one of said signal lines and said scanning lines; a plurality of thin-film transistors that form said drive circuit; and a threshold value control circuit being connected to said drive circuit for controlling a threshold value of said thin-film transistors.

According to a second aspect of the present invention, each of said thin-film transistors includes a control terminal through which the threshold value of said thin-film transistors is controlled, and said threshold value control circuit applies a desired voltage to said control terminal.

According to a third aspect of the present invention, said control terminal is formed in a channel contact region which is connected to a channel of said thin-film transistor, and said threshold value control circuit applies the desired voltage to said control terminal to change the channel, thus controlling the threshold value.

According to a fourth aspect of the present invention, the conductive type of said channel contact region is opposite to that of the channel of said thin-film transistors during operation thereof. Said channel contact region is p-type in case that the channel is n-type. Said channel contact region is n-type in case that the channel is p-type.

According to a fifth aspect of the present invention, said threshold value control circuit applies a voltage lower than a ground potential in order to reduce the power consumption of said drive circuit when said thin-film transistor is of the n-type.

According to a sixth aspect of the present invention, said threshold value control circuit applies a voltage higher than a supply potential in order to reduce the consumption power of said drive circuit when said thin-film transistor is of the p-type.

According to a seventh aspect of the present invention, said threshold value control circuit applies a voltage higher than a ground potential in order to improve the operating frequency of said drive circuit when said thin-film transistor is of the n-type.

According to an eighth aspect of the present invention, said threshold value control circuit applies a voltage lower than a supply potential in order to improve the operating frequency of said drive circuit when said thin-film transistor is of the p-type.

According to a ninth aspect of the present invention, said threshold value control circuit includes a variable resistor and adjusts the resistance of the variable resistor to apply the desired voltage to said control terminal.

According to a tenth aspect of the present invention, said threshold value control circuit includes a monitoring thin-film transistor that includes a threshold value control terminal for setting a reference value; a load for converting a current that flows in said monitoring thin-film transistor into a voltage; and an amplifier for amplifying a voltage developed across said load to apply an amplified voltage to said drive circuit, and to negatively feed back the amplified voltage to said threshold value control terminal of said monitoring thin-film transistor.

According to an eleventh aspect of the present invention, said threshold value control circuit is formed of a thin-film transistor on a substrate commonly used for that of said drive circuit.

According to a twelfth aspect of the present invention, said thin-film transistor is of a complementary transistor pair made up of an n-type transistor and a p-type transistor, the n-type transistor is provided with a first control terminal, the p-type transistor is provided with a second control terminal, and said threshold value control circuit applies desired voltages to the first and second control terminals, respectively.

According to a thirteenth aspect of the present invention, there is provided a liquid-crystal display unit, which comprises: a plurality of pixel portions which are arranged in the form of a matrix; a plurality of signal lines through which a display signal is supplied to said pixel portions; a plurality of scanning lines through which a scanning signal is supplied to said pixel portions; a signal-line drive circuit for driving said signal lines; a scanning-line drive circuit for driving said scanning-lines; a plurality of first thin-film transistors that form said signal-line drive circuit; a plurality of second thin-film transistors that form said scanning-line drive circuit; and a threshold value control circuit being connected to said signal-line drive circuit and said scanning-line drive circuit, for commonly controlling threshold values of said first and second thin-film transistors.

According to a fourteenth aspect of the present invention, there is provided a liquid-crystal display unit, which comprises: a plurality of pixel portions which are arranged in the form of a matrix; a plurality of signal lines through which a display signal is supplied to said pixel portions; a plurality of scanning lines through which a scanning signal is supplied to said pixel portions; a signal-line drive circuit for driving said signal lines; a scanning-line drive circuit for driving said scanning-lines; a plurality of first thin-film transistors that form said signal-line drive circuit; a plurality of second thin-film transistors that form said scanning-line drive circuit; a first threshold value control circuit being connected to said signal-line drive circuit, for controlling a threshold value of said first thin-film transistors; and a second threshold value control circuit being connected to said scanning-line drive circuit, for controlling a threshold value of said second thin-film transistors independently of said first threshold value control circuit.

According to a fifteenth aspect of the present invention, said first threshold value control circuit controls the threshold value so as to improve the operating frequency of said signal-line drive circuit, and said second threshold value control circuit controls the threshold value so as to reduce the power consumption of said scanning-line drive circuit.

In the liquid-crystal display unit of the present invention, the pixel portions are arranged in the form of a matrix, and there is provided the drive circuit for driving the signal lines through which the display signal is supplied to the pixel portions or the scanning lines through which the scanning signal is supplied to the pixel portions. The drive circuit is made up of a plurality of thin-film transistors. The drive circuit is connected with the threshold value control circuit for controlling the threshold value of the thin-film transistors. In the present invention, the threshold value control circuit is so designed as to control the threshold value of the thin-film transistors, thereby reducing the power consumption of the drive circuit or improving the operating frequency.

Each of the thin-film transistors is provided with the control terminal through which the threshold value is controlled. The threshold value control circuit applies to the desired voltage to the control terminal. Specifically, each of the control terminals is formed in the channel contact region which is connected to the channel of each thin-film transistor, and the threshold value control circuit applies the desired voltage to the control terminal to change the channel, thus controlling the threshold value.

The channel contact region is opposite in conductive type to the channel of said thin-film transistors. For example, when said thin-film transistors are of the n-type, the channel contact region is of the p-type. In this case, the channel contact region is formed by doping the region with p-type impurities. In this manner, the thin-film transistors each having the control terminal are formed. With such a structure, upon applying a voltage to the control terminal by the threshold value control circuit, the channel contact region functions as a so-called back gate, thereby influencing the channel of the thin-film transistor. As a result, the threshold value of the thin-film transistor can be controlled.

In this situation, the applied voltage is different between a case in which the power consumption of the drive circuit is to be reduced and a case in which the operating frequency is to be improved. Furthermore, the applied voltage depends on the polarity of the thin-film transistors. Specifically, when the thin-film transistors are of the n-type, a voltage lower than a ground potential is applied to the control terminal in order to reduce the consumption power of said drive circuit, or a voltage higher than the ground potential is applied to the control terminal in order to improve the operating frequency. On the other hand, when the thin-film transistors are of the p-type, a voltage higher than a supply voltage is applied to the control terminal in order to reduce the consumption power of said drive circuit, or a voltage lower than the supply voltage is applied to the control terminal in order to improve the operating frequency.

It should be noted that the control of the threshold value may be conducted by monitoring a current value of the drive circuit or a current value of the individual thin-film transistors, or automatically conducted by conducting the negative feedback. In the former case, the variable resistor is disposed in the threshold value control circuit so that the resistance of the variable resistor is adjusted, thus applying the desired voltage to the control terminal.

In the latter case, the threshold value control circuit may include the monitoring thin-film transistor for setting a reference value, the load for converting a current that flows in the monitoring thin-film transistor into a voltage, and the amplifier for amplifying a voltage developed across the load to apply an amplified voltage to the drive circuit and to negatively feed back the amplified voltage to the threshold value control terminals of the monitoring thin-film transistors. In the latter case, it is preferable that the threshold value control circuit is formed of a thin-film transistor on a substrate commonly used for that of the drive circuit.

Also, in the case where the thin-film transistors are of a complementary transistor pair (CMOS), the n-type transistor is provided with the first control terminal, the p-type transistor is provided with the second control terminal, so that the threshold value control circuit applies desired voltages to the first and second control terminals, respectively.

Also, the drive circuit includes the signal-line drive circuit for driving the signal lines, and the scanning-line drive circuit for driving the scanning lines. In this case, those drive circuits may be so designed as to be connected with one threshold value control circuit, to thereby commonly control the threshold values of the respective thin-film transistors, or the respective drive circuits may be so designed as to be connected with individual threshold value control circuits, to thereby control the threshold values of the respective thin-film transistors, independently. In particular, in the latter case, the threshold values of the respective thin-film transistors can be controlled by the first threshold value control circuit so as to improve the operating frequency of the signal-line drive circuit, and also they can be controlled by the second threshold value control circuit so as to reduce the power consumption of the scanning-line drive circuit. The reason why the threshold values are controlled independently is that the signal-line drive circuit and the scanning-line drive circuit are different in operating frequency. In other words, the operating frequency is more important to the signal-line drive circuit, whereas the power consumption is more important to the scanning-line drive circuit.

BRIEF DESCRIPTION OF THE DRAWINGS

The present invention will be more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Now, a description will be given of the preferred embodiments of the present invention with reference to the accompanying drawings.

Figure 7:
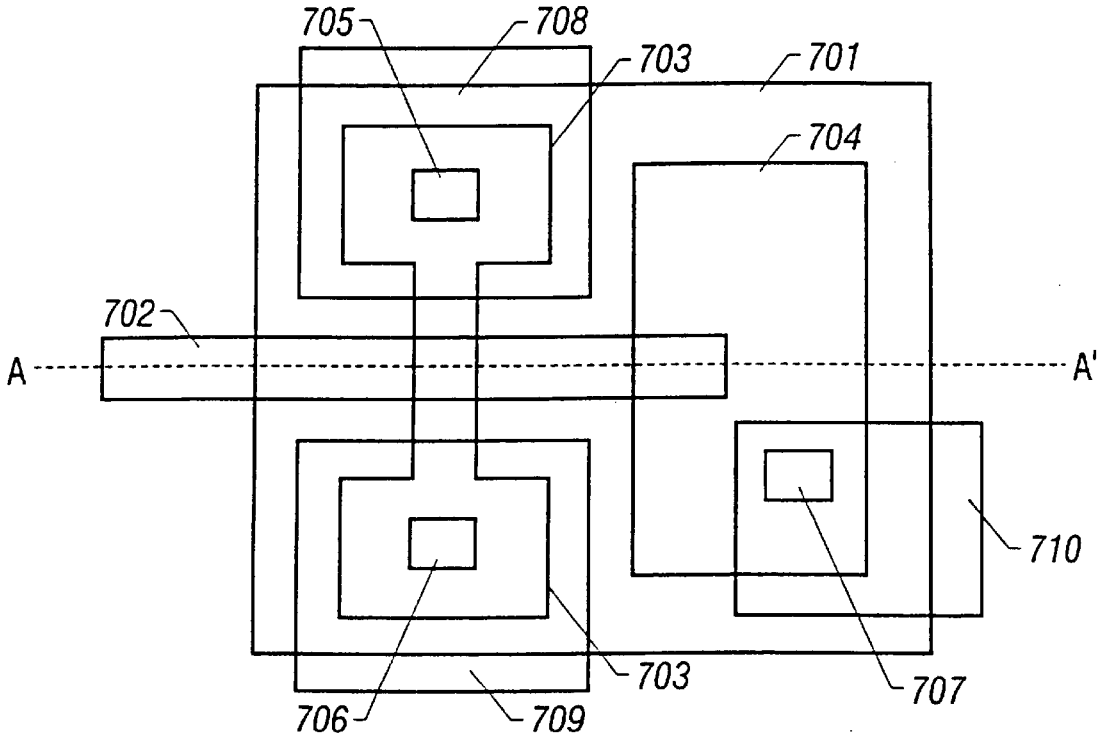
FIG. 7 is a plan view showing a TFT used in the present invention.

First, a TFT used in the present invention will be described with reference to FIG. 7. In this embodiment, it is assumed that the TFT is of the n-type. FIG. 7 is a structural view (a plan view) showing the n-type TFT. First, an island-like region 701 made of intrinsic polysilicon is formed. Then, a gate insulating film is formed, and a gate electrode film is formed on the gate insulating film. The gate electrode film is etched to form a gate electrode 702. Thereafter, the island-like region 701 is doped with n-type impurities to form an n-type source/drain region 703. In this process, no impurities are inserted immediately under the gate electrode 702 because doping is conducted after the formation of the gate electrode 702.

Subsequently, the island-like region 701 is doped with p-type impurities to form a channel contact region 704. In this embodiment, the island-like region 701 is doped with p-type impurities after being doped with the n-type impurities, however, the processing order may be reversed. Thereafter, an interlayer film is formed thereon to define contact holes 705, 706 and 707. Then, an electrode metal film is formed thereon to form a source electrode 708, a drain electrode 709 and a threshold value control terminal electrode 710. In this embodiment, a TFT having a threshold value control terminal can be formed. In the above processes, there is no newly added process because of CMOS so that the element can be formed in the same process as the conventional process.

Figure 8A:
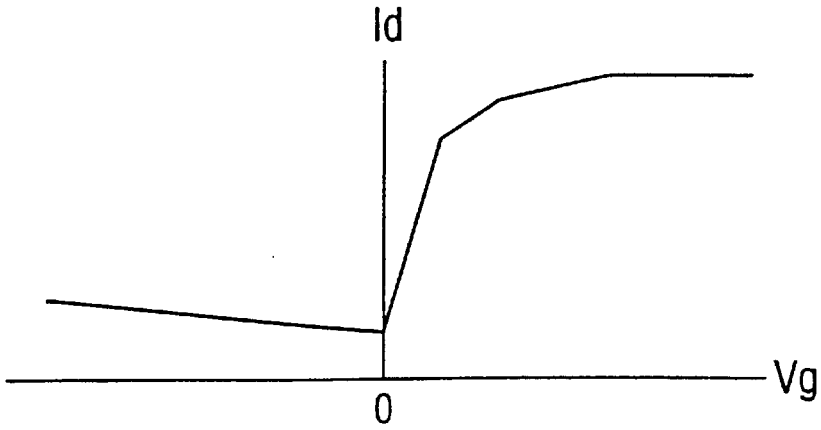
FIGS. 8A to 8C are graphs representative of the drain current to gate voltage characteristic of the TFT.
Figure 8B:
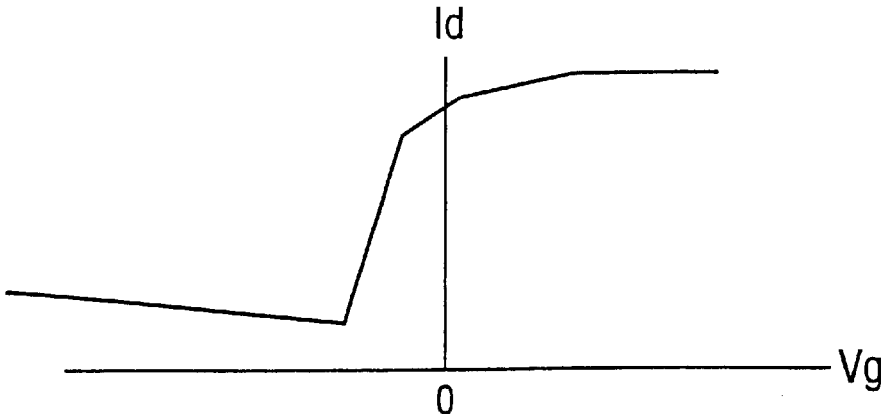
Figure 8C:
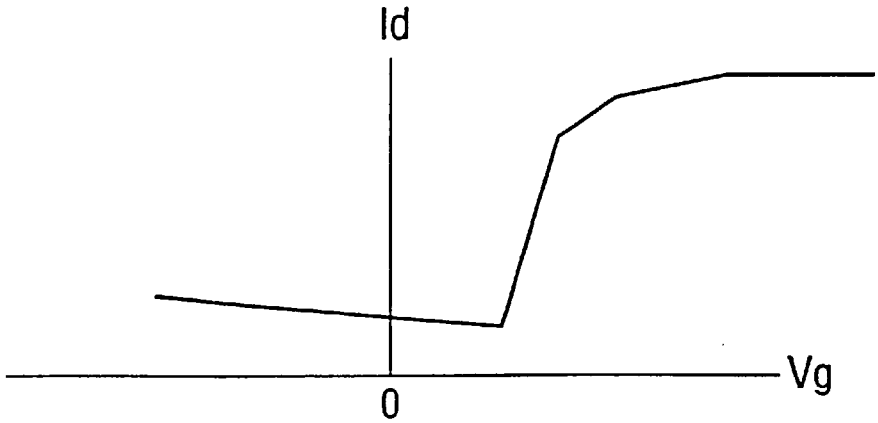

Subsequently, the electric characteristic of the TFT will be described. First, the characteristic of the TFT when no voltage is applied to the threshold value control terminal electrode 710 is shown in FIG. 8A. In this case, the characteristic of the TFT is identical with that of the conventional TFT having no threshold value control terminal electrode 710. Then, the characteristic of the TFT when a positive voltage is applied to the threshold value control terminal electrode 710 is shown in FIG. 8B, and the characteristic of the TFT when a negative voltage is applied thereto is shown in FIG. 8C.

Figure 9:
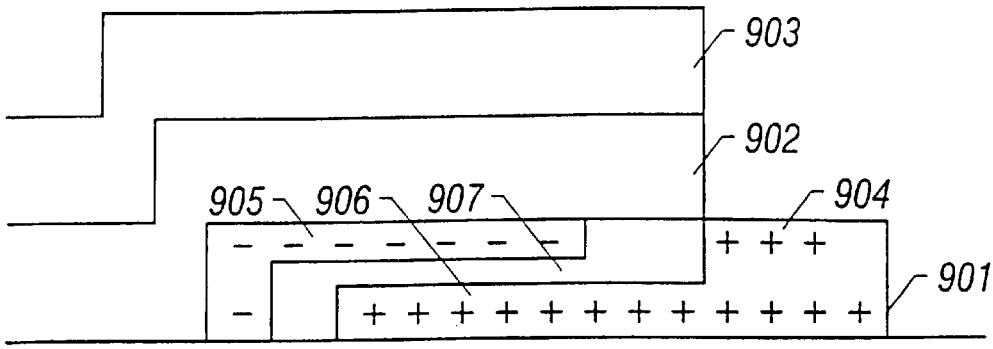
FIG. 9 is a cross-sectional view showing the TFT.

The operation of the TFT will be described with reference to a cross-sectional view of the TFT (FIG. 9). The cross-sectional view of FIG. 9 is a cross-section taken along a dotted line A–A' of FIG. 7. When the n-type TFT turns on, an n-type channel 905 is formed under a gate oxide film 902. In this situation, a p-type layer 906 is formed on the lower side of the channel which is made of polysilicon. In this situation, in the floating state where no voltage is applied to the p-type layer 906, the operation of the TFT is identical with that of the conventional TFT. However, upon applying a voltage to the channel contact region 704 from the control terminal 710, the p-type layer 906 acts as a back gate, thereby influencing the channel 905.

When a negative voltage is applied to the p-type layer 906, a depletion layer 907 defined between the channel 905 which is an n-type layer of the channel and the p-type layer 906 formed under the channel 905 spreads and serves to suppress the channel 905, thereby making it difficult to allow a current to flow into the channel 905. As a result, the threshold value becomes large. On the other hand, when a positive voltage is applied to the p-type layer 906, the depletion layer 907 is narrowed to make the current readily flow thereinto. As a result, the threshold value is reduced. Thus, a description was given of the n-type TFT. The same description is applied to the p-type TFT with the reverse of the polarity.

Figure 10:
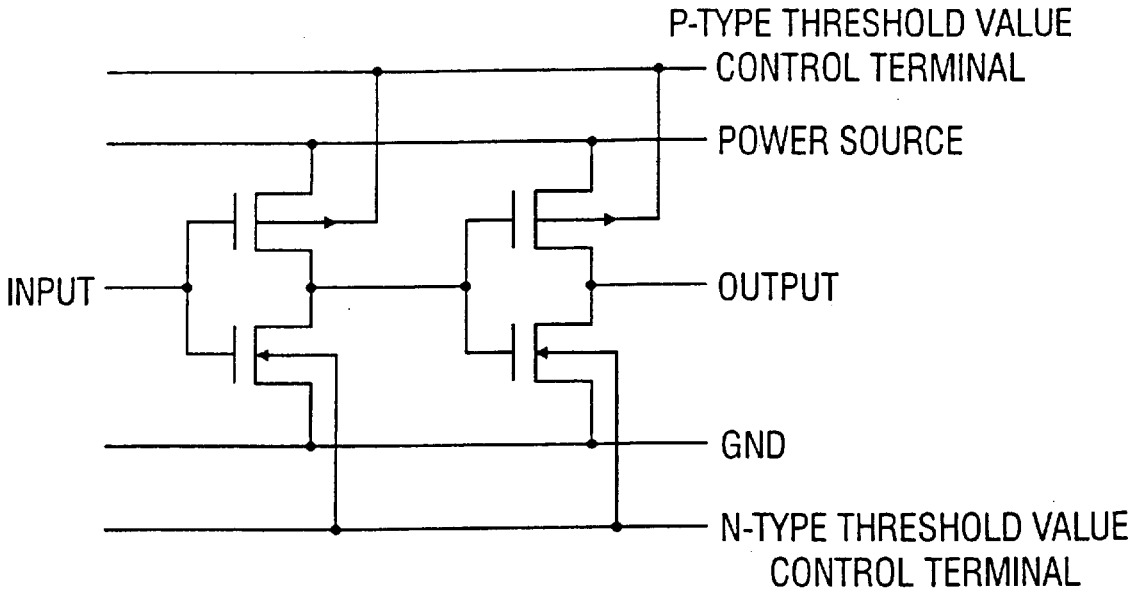
FIG. 10 is a diagram showing an example of the invertor circuit.

Subsequently, the operation of the drive circuit in accordance with the present invention will be described in view of the characteristic of the TFT. FIG. 10 shows an invertor array as one example of the drive circuit. This shows the invertor as an example, but the same description is applicable to a shift register, decoder or the like instead of the invertor. A CMOS invertor circuit normally includes four terminals for an input, an output, a power supply and GND. However, the invertor of the present invention includes six terminals with the addition of control terminals of the n-type TFT and the p-type TFT, and those control terminals are so controlled as to control the threshold values of the TFTs that constitutes the circuit.

Figure 1:
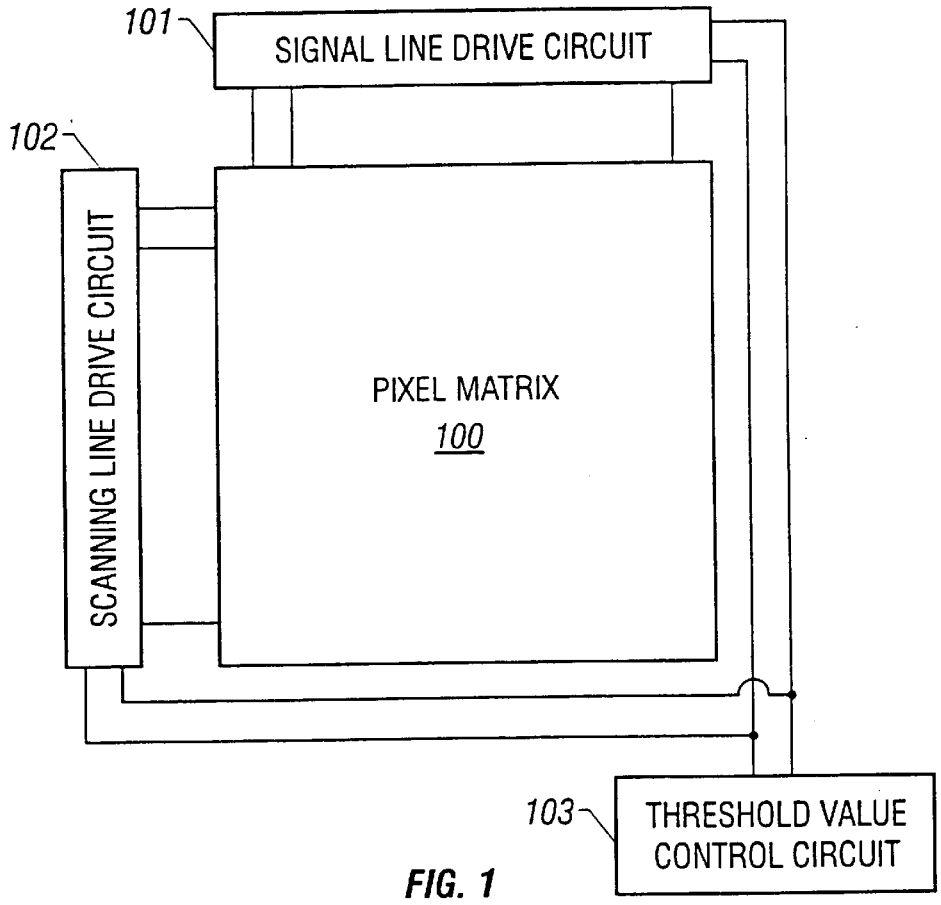
FIG. 1 is a diagram showing a matrix type liquid-crystal display unit in accordance with a first embodiment of the present invention.
Figure 2:
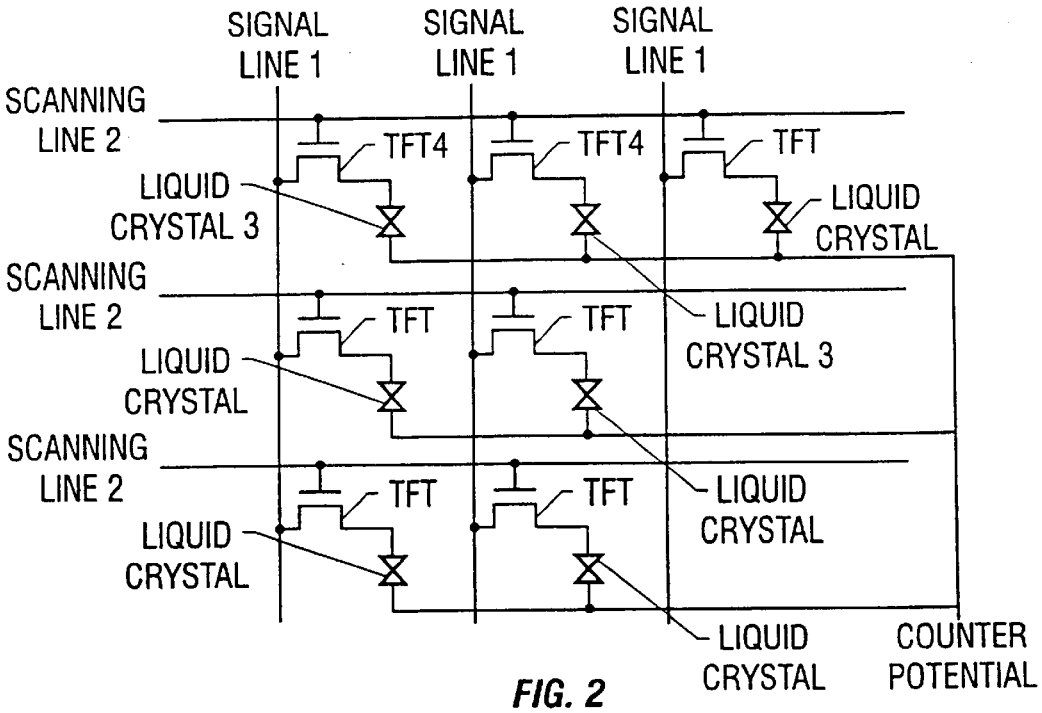
FIG. 2 is a diagram showing an example of an active matrix using TFTs.
Figure 3A:
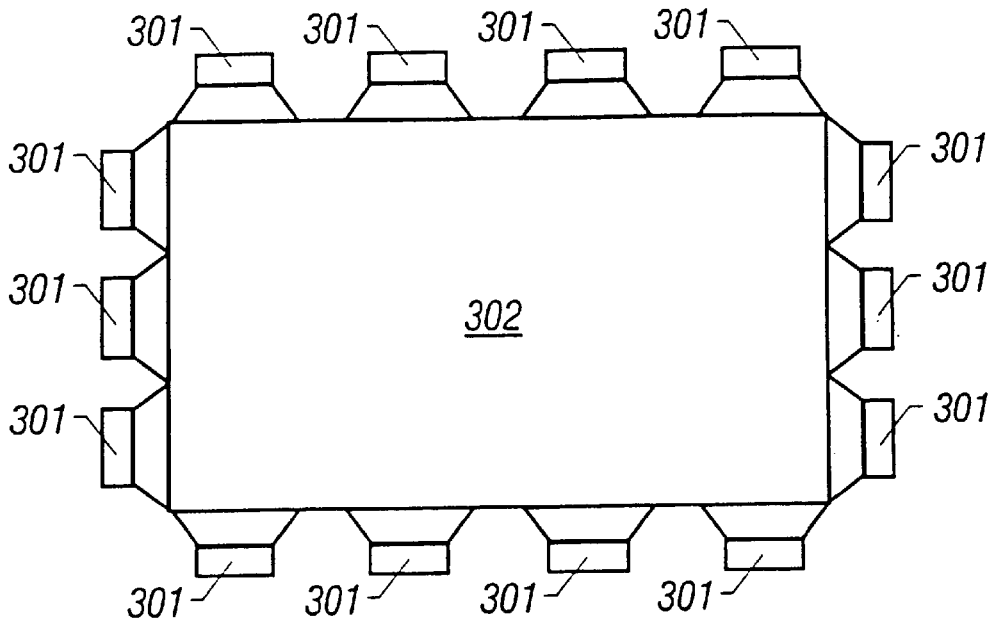
FIGS. 3A and 3B are diagrams showing a conventional example of the active matrix using amorphous silicon TFTs.
Figure 3B:
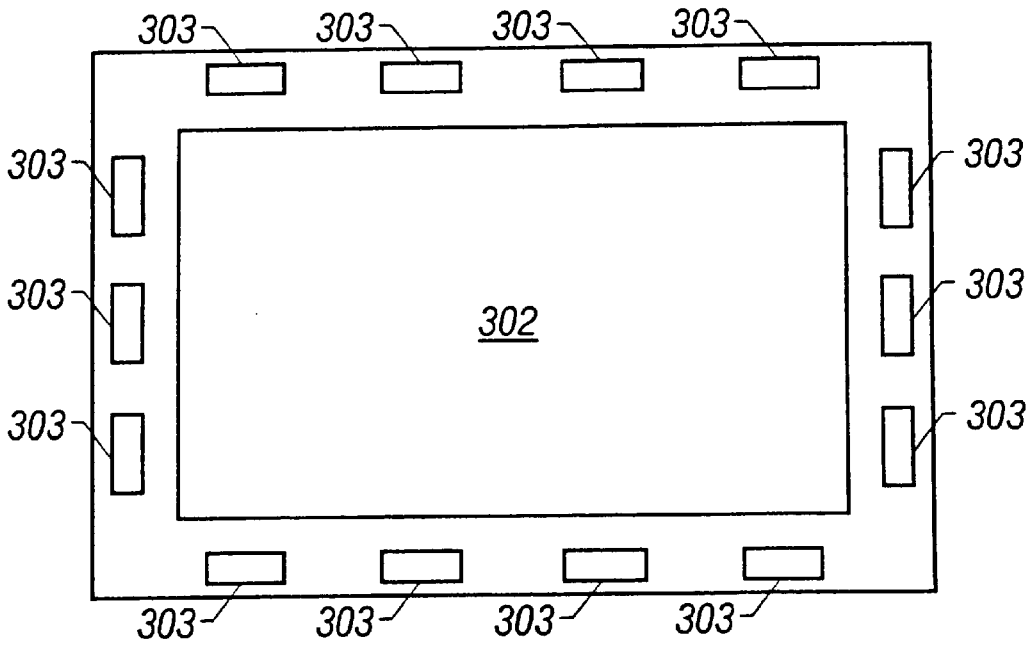
Figure 4A:
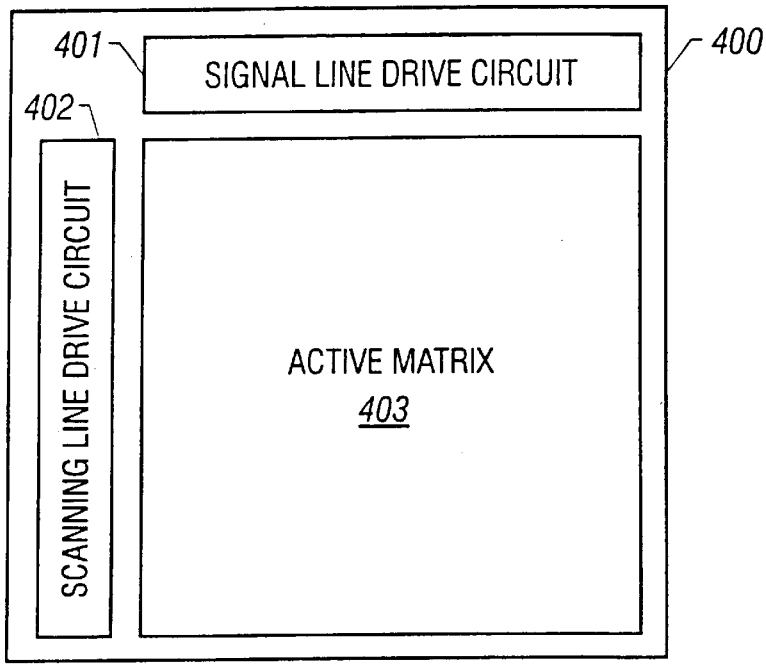
FIGS. 4A and 4B are diagrams showing a conventional example of the active matrix using polysilicon TFTs.
Figure 4B:
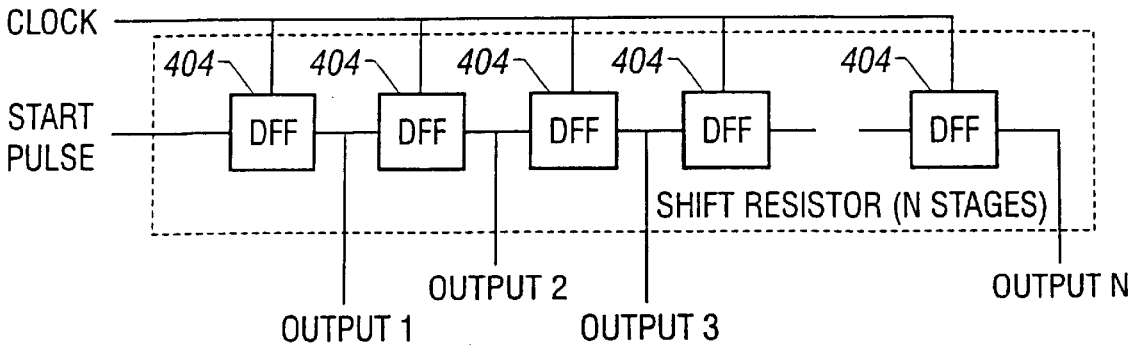
Figure 5A:
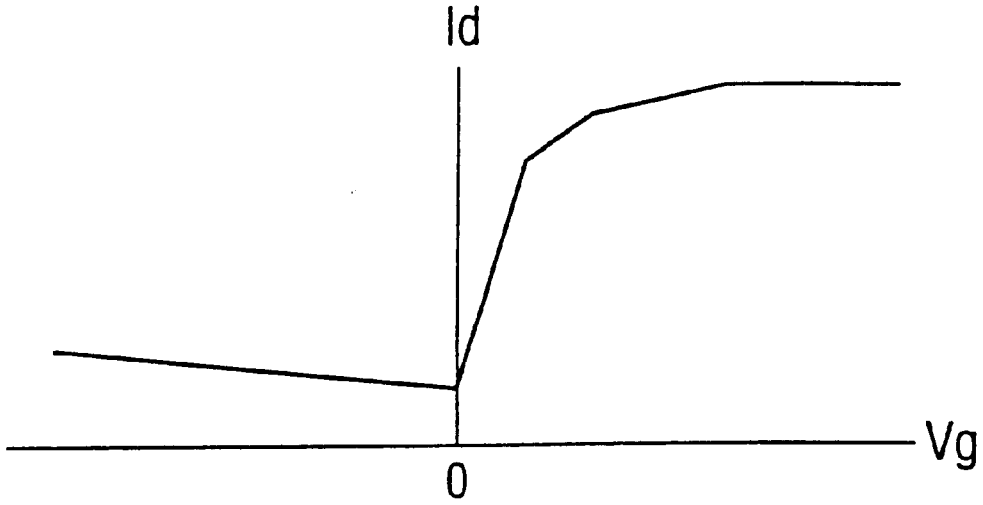
FIGS. 5A and 5B are graphs representative of the drain current to gate voltage characteristic of the conventional TFT.
Figure 5B:
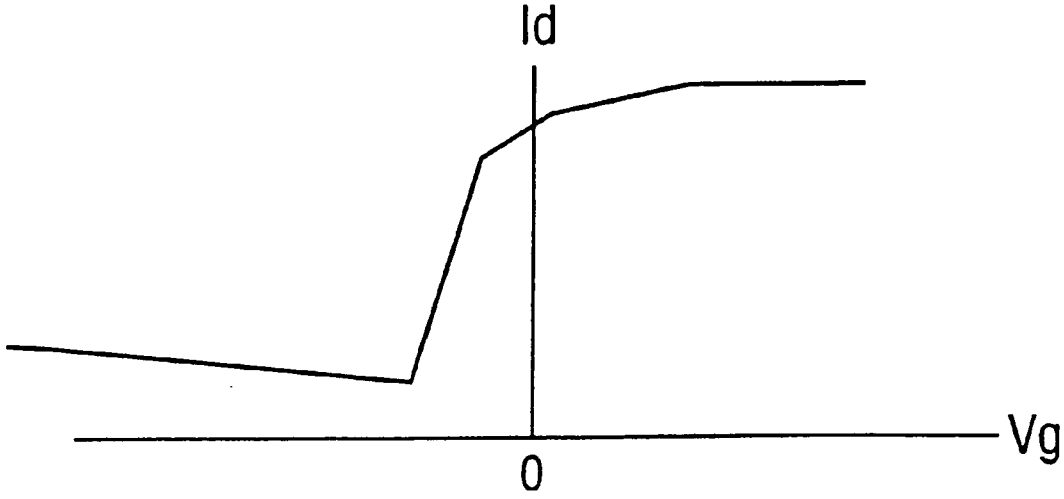
Figure 6:
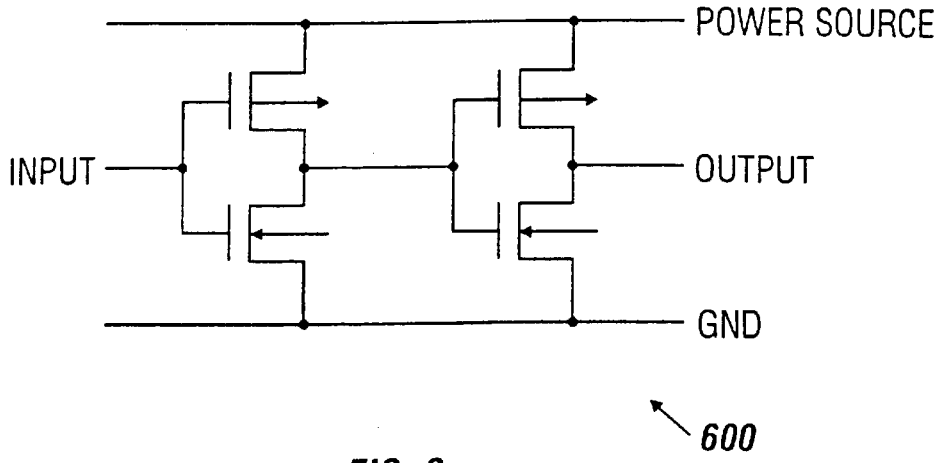
FIG. 6 is a diagram showing an example of an invertor circuit.

FIG. 1 shows a first embodiment of the present invention. In this embodiment, a threshold value control terminal (reference numeral 710 in FIG. 7) of the TFT that constitutes the signal-line drive circuit 101 and the scanning-line drive circuit 102 is taken out and controlled by a threshold value control circuit 103. As described above, in the case where an attempt is made to reduce the power consumption with the TFT being in a normally on-state, a voltage lower than the GND potential is applied to the threshold value control terminal of the n-type TFT whereas a voltage higher than a supply voltage is applied to the threshold value control terminal of the p-type TFT, thus increasing the threshold value. Reference numeral 100 denotes a pixel matrix.

Also, in the case where an attempt is made to make the operating frequency of the drive circuits (101, 102) high, a voltage higher than the GND potential is applied to the threshold value control terminal of the n-type TFT whereas a voltage lower than the supply voltage is applied to the threshold value control terminal of the p-type TFT, thus lowering the threshold value. In any case, the operation principle of the scanning-line drive circuit 102 and the signal-line drive circuit 101 are identical with those in the conventional case.

Figure 11A:
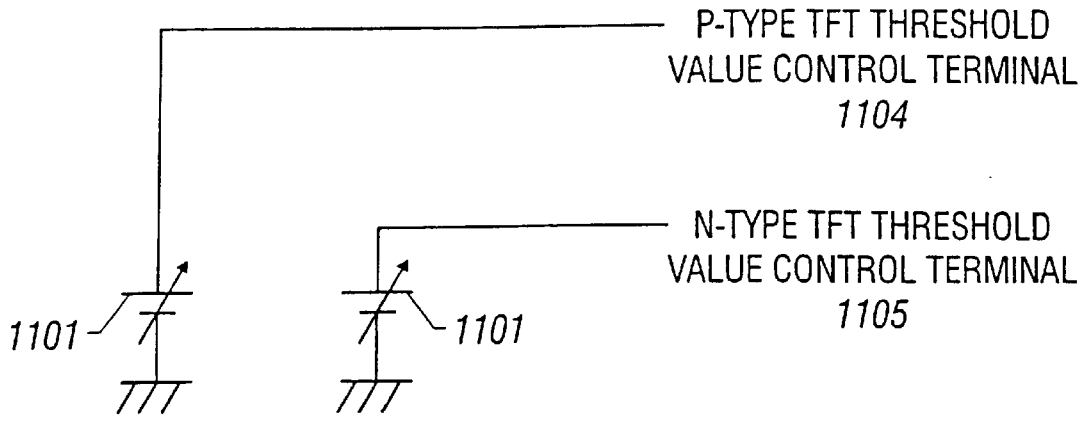
FIGS. 11A and 11B show threshold value control circuits in accordance with a first embodiment of the present invention.
Figure 11B:
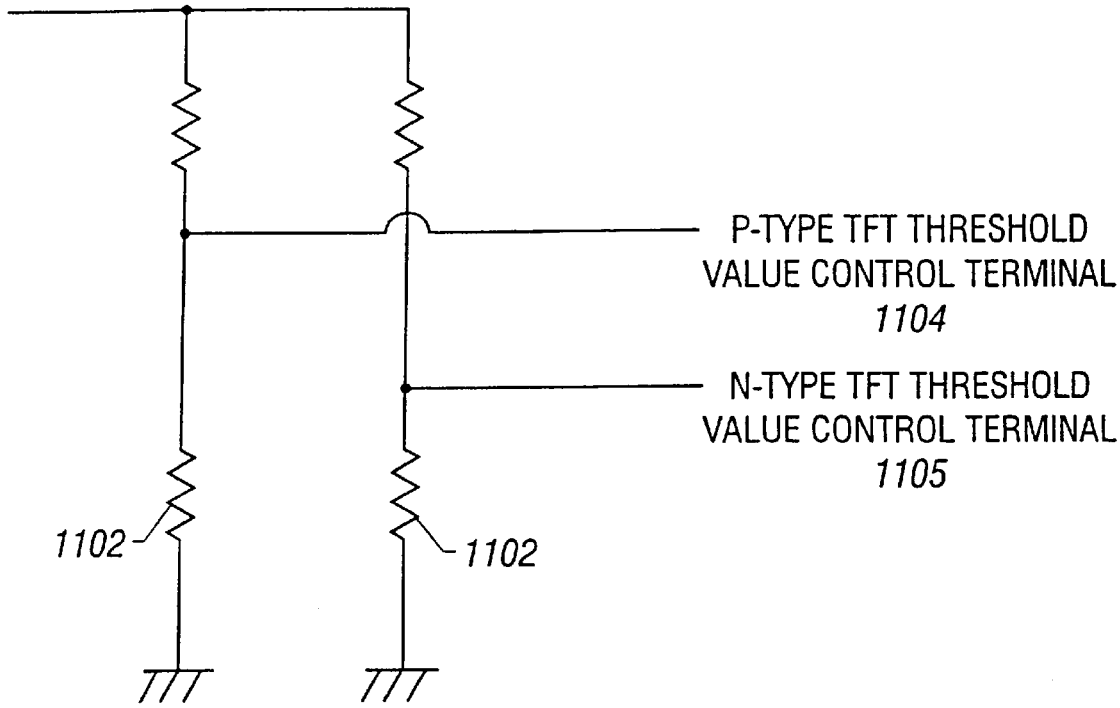

What is shown in FIGS. 11A and 11B is an example of the circuit diagram of the threshold value control circuit 103. In this embodiment, since the control voltage is not changed with time, a p-type TFT threshold value control terminal 1104 and an n-type TFT threshold value control terminal 1105 may be connected with a voltage source 1101, respectively, to give a required voltage thereto (FIG. 11A), or may be connected with a variable resistor 1102 to give a voltage thereto (FIG. 11B). In this example, in the case of controlling the threshold value, while monitoring a current value of the drive circuit or a current value of the individual TFTs, a voltage is set for optimization.

Figure 12:
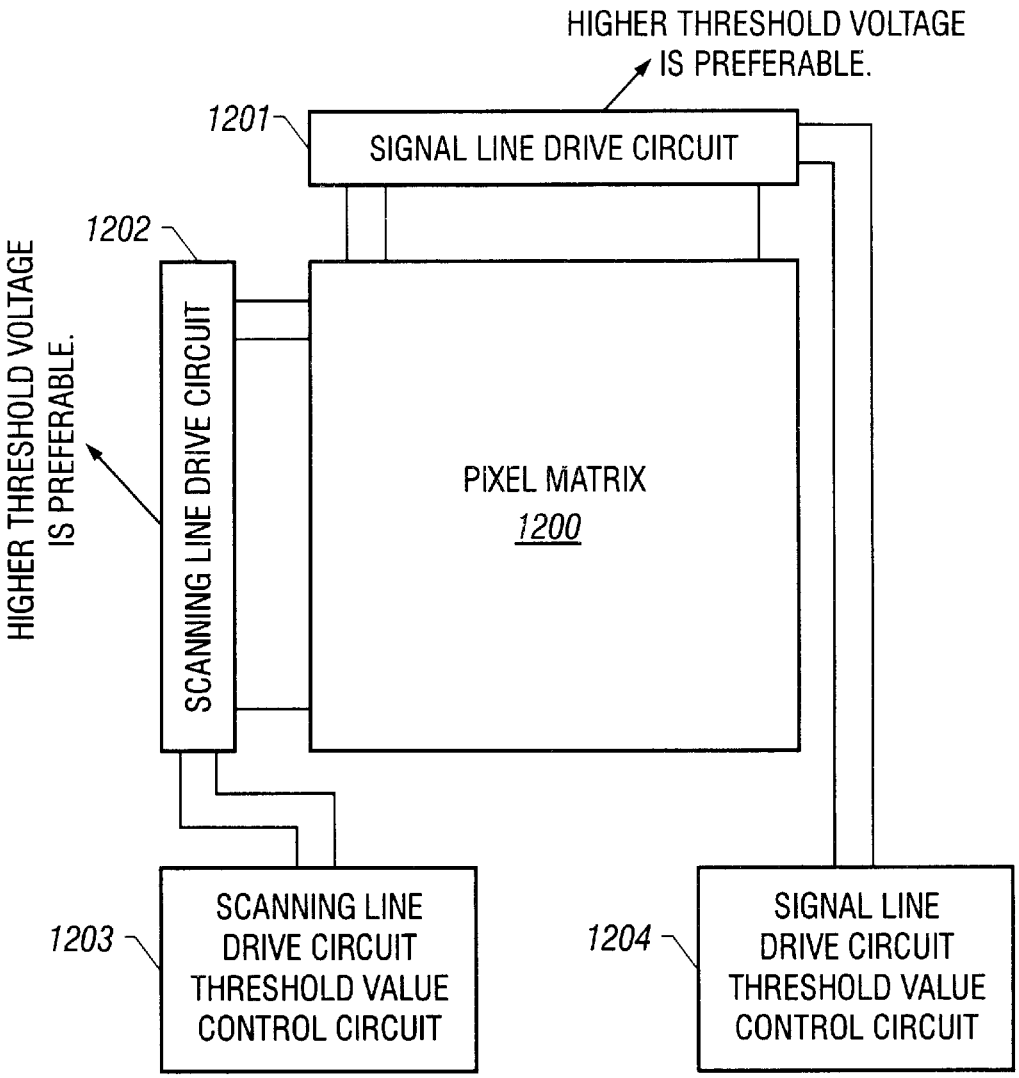
FIG. 12 is a diagram showing a matrix type liquid-crystal display unit in accordance with a second embodiment of the present invention.

FIG. 12 shows a second embodiment of the present invention. In this example, control is conducted without making common the threshold value control voltage of the signal-line drive circuit 1201 and the scanning-line drive circuit 1202, which is different from the first embodiment. In general, the operating frequency of the signal-line drive circuit 1201 is MHz in unit whereas that of the scanning-line drive circuit 1202 is KHz in unit. Hence, the operating frequency of the signal-line drive circuit 1201 is required to be increased whereas that of the scanning-line drive circuit 1202 is not required to be increased. Consequently, in the case of controlling the threshold value, the operating frequency is important to the signal-line drive circuit 1201, whereas the power consumption is important to the scanning-line drive circuit 1202. In this example, the structure of the threshold value control circuit per se is identical with that in the first embodiment. However, this embodiment is different from the first embodiment in that this embodiment uses two independent threshold value control circuits 1203 and 1204. It should be noted that reference numeral 1200 denotes a pixel matrix.

Figure 13:
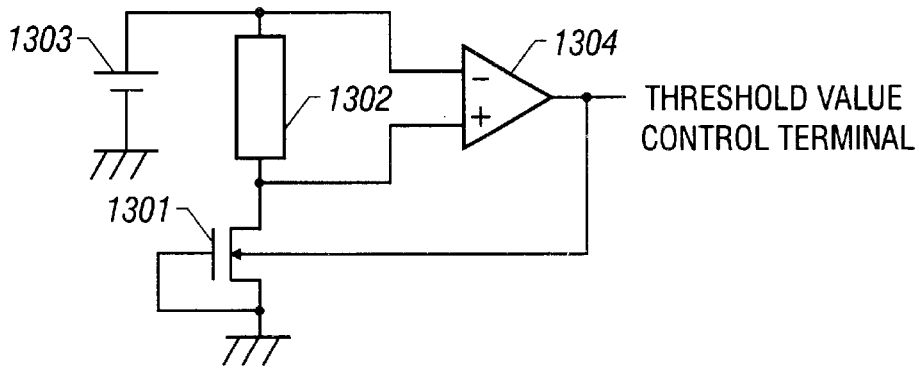
FIG. 13 is a diagram showing a threshold value control circuit in accordance with the second embodiment of the present invention.

FIG. 13 shows an example of the circuit structure of the second threshold value control circuit used in the present invention. In this example, the threshold value control circuit is made up of not an external variable resistor or a variable voltage source but a thin-film transistor formed on a substrate which is commonly used as that of the drive circuit. In this example, the circuit is made up of a monitor TFT 1301 which is a reference of control, a load 1302 that converts a current flowing in the monitor TFT 1301 into a voltage, and an amplifier 1304 that amplifies a voltage developed across the load 1302 to apply a voltage to the threshold value control terminals of the drive circuit and the monitor TFT 1301.

Hereinafter, the operation of the above second threshold value control circuit will be described. When the TFT 1301 is normally on, a drain current flows in the monitor TFT 1301, thereby making a voltage develop across the load 1302. That voltage is inputted to a non-inverse input terminal of differential inputs of the amplifier 1304 so that a differential voltage between the voltage across the load 1302 and a reference voltage 1303 is amplified and outputted. Because the differential voltage output thus amplified is adapted to the non-inverse input, it is outputted with a lowered value. The output terminal of the amplifier 1304 is connected to the voltage control terminals of the monitor TFT 1301 and the drive circuit, and in order to lower the voltage, a voltage across the threshold value control terminal is lowered, the threshold value of the TFT is increased so that the drain current flowing in the TFT is restrained. In this manner, a negative feedback is conducted in combination with the monitor TFT 1301 and the amplifier 1304, thereby being capable of automatically controlling the threshold value.

As described above, the feedback circuit is structured assuming that the TFT is normally on. However, if the gate voltage of the monitor TFT 1301 is fixed to a potential which is not a source potential, and a reference voltage is set appropriately, the threshold value can be freely set.

Figure 14:
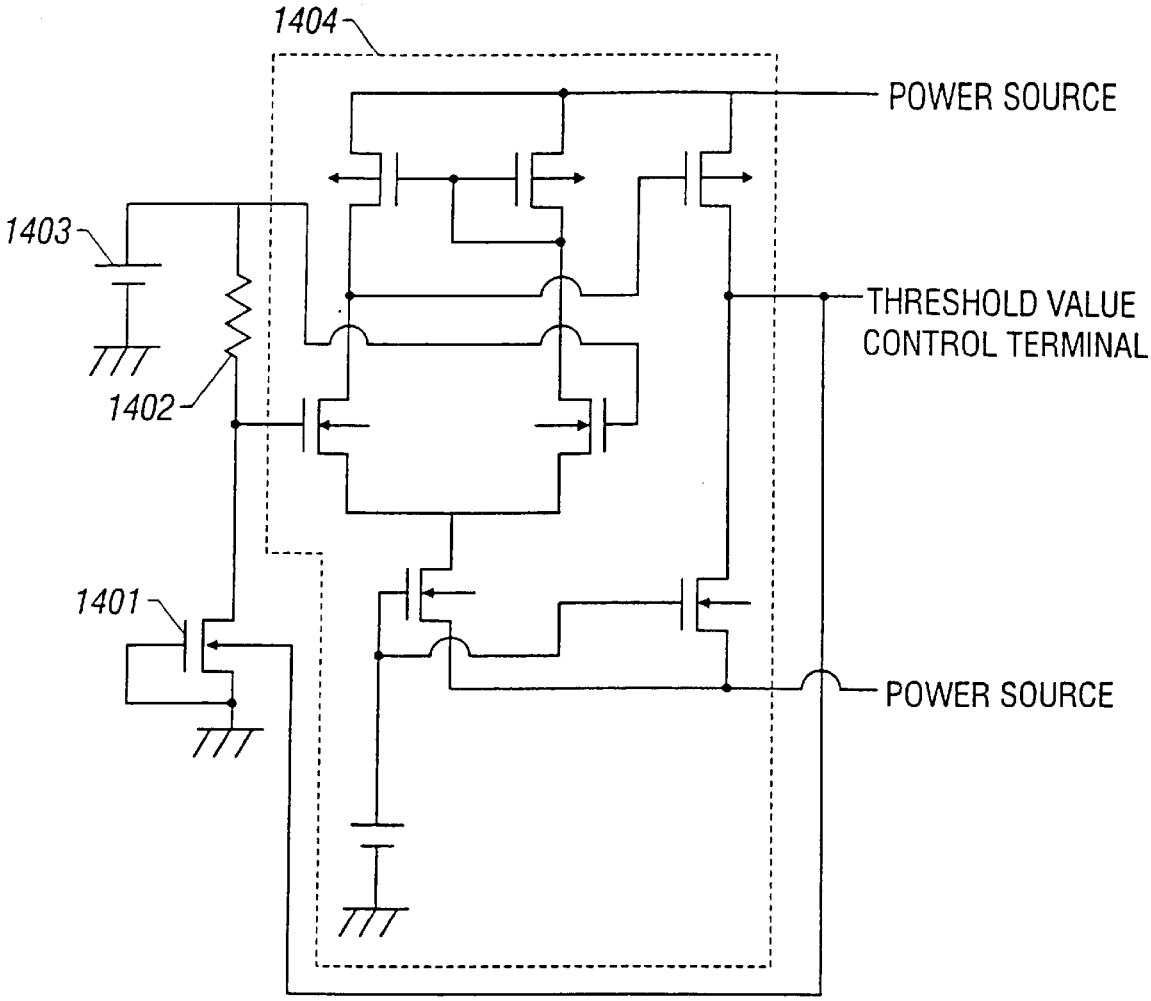
FIG. 14 is a diagram showing an equivalent circuit example of the threshold value control circuit.

What is shown in FIG. 14 is a specified example of the threshold value control circuit shown in FIG. 13 using TFTs. The amplifier is formed of an operational amplifier including a differential circuit made up of the n-type TFT and an active load made up of the p-type TFT.

In the above-mentioned embodiments, the threshold value of the TFT that forms a drive circuit is controlled. Instead, the threshold value of the TFT that forms the pixel portion may be controlled.

According to the present invention, the threshold value of the TFT is controlled by the application of a voltage, thereby being capable of reducing the power consumption of the drive circuit. Also, the operating frequency of the drive circuit is improved.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A semiconductor device comprising:

a substrate having an insulating surface;

a semiconductor island formed over the substrate, said semiconductor island including source and drain regions doped with a first impurity, channel region formed in the semiconductor island between said source and drain regions, a channel contact region formed in the semiconductor island, said channel contact region doped with a second impurity for providing an opposite conductivity type to that of the source and drain regions;

a gate insulating film adjacent to the channel contact region; and a gate electrode adjacent to the gate insulating film, wherein the channel contact region is electrically connected to the channel region.

2. The semiconductor device according to claim 1 further comprising a terminal allowing applying a voltage to the channel contact region, which influences a formation of the channel region.

3. The semiconductor device according to claim 1 wherein the gate electrode is located over the channel region.

4. A shift register having at least one thin film transistor, the thin film transistor comprising:

a substrate having an insulating surface;

a semiconductor island formed over the substrate, said semiconductor island including source and drain regions doped with a first impurity, a channel region formed in the semiconductor island between said source and drain regions, a channel contact region formed in the semiconductor island, said channel contact region doped with a second impurity for providing an opposite conductivity type to that of the source and drain regions;

a gate insulating film adjacent to the channel contact region; and a gate electrode adjacent to the gate insulating film, wherein the channel contact region is electrically connected to the channel region.

5. The semiconductor device according to claim 4 further comprising a terminal allowing applying a voltage to the channel contact region, which influences a formation of the channel region.

6. The semiconductor device according to claim 4 wherein the gate electrode is located over the channel region.

7. An active matrix type display device comprising:

a plurality of pixels over a substrate;

a plurality of thin film transistors provided at the plurality of pixels;

a plurality of signal lines formed over the substrate for supplying display signals to the plurality of pixels;

a plurality of scanning lines extending across the plurality of signal line;

a signal line driver circuit for driving the plurality of signal lines, wherein the signal line driver circuit comprises at least one second thin film transistor formed over the substrate; and a scanning line driver circuit formed over the substrate for driving the plurality of scanning lines, wherein said at least one second thin film transistor of the signal line driver circuit comprises:

a semiconductor island formed over the substrate, said semiconductor island including source and drain regions doped with a first impurity, a channel region formed in the semiconductor island between said source and drain regions, a channel contact region formed in the semiconductor island, said channel contact region doped with a second impurity for providing an opposite conductivity type to that of the source and drain regions;

a gate insulating film adjacent to the channel contact region; and a gate electrode adjacent to the gate insulating film, wherein the channel region is electrically connected to the channel contact region.

8. The semiconductor device according to claim 7 further comprising a terminal allowing applying a voltage to the channel contact region, which influences a formation of the channel region.

9. The semiconductor device according to claim 7 wherein the gate electrode is located over the channel region.

10. An active matrix type display device comprising:

a plurality of pixels over a substrate;

a plurality of thin film transistors provided at the plurality of pixels;

a plurality of signal lines formed over the substrate for supplying display signal to the plurality of pixels;

a plurality of spanning lines extending across the plurality of signal lines;

a signal line driver circuit formed over the substrate for driving the plurality of signal lines; and a scanning line driver circuit for driving the plurality of scanning lines, wherein the scanning line driver circuit comprises at least one second thin film transistor formed over the substrate, wherein said at least one second thin film transistor of the signal line driver circuit comprises:

a semiconductor island formed over the substrate, said semiconductor island including source and drain regions doped with a first impurity, channel region formed in the semiconductor island between said source and drain regions, a channel contact region formed in the semiconductor island, said channel contact region doped with a second impurity for providing an opposite conductivity type to that of the source and drain regions;

a gate insulating film adjacent to the channel contact region; and a gate electrode adjacent to the gate insulating film, wherein the channel contact region is electrically connected to the channel region.

11. The semiconductor device according to claim 10 further comprising a terminal allowing applying a voltage to the channel contact region which influences a formation of the channel region.

12. The semiconductor device according to claim 10 wherein the gate electrode is located over the channel region.

13. An active matrix type display device comprising:

a plurality of pixels over a substrate;

a plurality of signal lines formed over the substrate for supplying display signals to the plurality of pixels;

a plurality of scanning lines extending across the plurality of signal lines;

a signal line driver circuit for driving the plurality of signal lines, wherein the signal line driver circuit comprises at least one first thin film transistor over the substrate; and a scanning line driver circuit for driving the plurality of scanning lines, wherein the scanning line driver circuit comprises at least one second thin-film transistor formed over the substrate, each of the at least one first and second thin film transistors comprising:

a semiconductor island having source, drain and channel regions therein;

a gate electrode adjacent to the channel region with a gate insulating film interposed between the gate electrode and the channel region; and a terminal allowing applying a voltage to influence the formation of the channel region, wherein the voltage applied to the terminal of the first thin film transistor of the signal line driver circuit is so selected that a threshold voltage of the first thin film transistor is lower than a state where no voltage is applied thereto while the voltage applied to the terminal of the second thin film transistor of the scanning line driver circuit is so selected that a threshold voltage of the second thin film transistor is higher than a state where no voltage is applied thereto.

14. The semiconductor device according to claim 12 wherein the gate electrode is located over the channel region.

15. An active matrix type display device comprising:

a plurality of pixels over a substrate;

a plurality of signal lines formed over the substrate for supplying display signals to the plurality of pixels;

a plurality of scanning lines extending across the plurality of signal lines;

a signal line driver circuit for driving the plurality of signal lines, wherein the signal line driver circuit comprises at least one first thin film transistor over the substrate; and a scanning line driver circuit for driving the plurality of scanning lines, wherein the scanning line driver circuit comprises at least one second thin film transistor formed over the substrate, each of the at least one first and second thin film transistors comprising:

a semiconductor island having source, drain and channel regions therein; and a gate electrode adjacent to the channel region with a gate insulating film interposed between the gate electrode and the channel region, wherein the first thin film transistor of the signal line driver circuit includes means for decreasing a threshold voltage thereof, and the second thin film transistor of the scanning line driver circuit is provided with means for increasing a threshold voltage thereof.

16. The semiconductor device according to claim 15 wherein the gate electrode is located over the channel region.

* * * * *